US011372345B2

(12) United States Patent
Maezawa

(10) Patent No.: US 11,372,345 B2
(45) Date of Patent: Jun. 28, 2022

(54) DEVELOPING ROLLER, DEVELOPING DEVICE, IMAGE FORMING APPARATUS

(71) Applicant: KYOCERA Document Solutions Inc., Osaka (JP)

(72) Inventor: Nobuhiro Maezawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/449,907

(22) Filed: Oct. 4, 2021

(65) Prior Publication Data

US 2022/0107582 A1 Apr. 7, 2022

(30) Foreign Application Priority Data

Oct. 6, 2020 (JP) ..... JP2020-168984

(51) Int. Cl.
*G03G 15/08* (2006.01)

(52) U.S. Cl.
CPC ..... *G03G 15/0808* (2013.01)

(58) Field of Classification Search
CPC ..... G03G 15/0808
See application file for complete search history.

(56) References Cited

U.S. PATENT DOCUMENTS

2006/0198664 A1* 9/2006 Ebe ..... G03G 15/0818 399/286
2008/0298854 A1* 12/2008 Ebe ..... G03G 15/0818 399/279
2009/0214272 A1* 8/2009 Furuya ..... G03G 15/0818 399/286
2021/0232058 A1* 7/2021 Nakazato ..... G03G 15/0216
2022/0050401 A1* 2/2022 Ishino ..... G03G 15/0808
2022/0107580 A1* 4/2022 Ota ..... G03G 15/0818
2022/0107584 A1* 4/2022 Tamaki ..... G03G 15/065
2022/0107585 A1* 4/2022 Nakaue ..... G03G 15/0812

FOREIGN PATENT DOCUMENTS

JP 2002304053 A 10/2002

* cited by examiner

*Primary Examiner* — Sevan A Aydin
(74) *Attorney, Agent, or Firm* — Alleman Hall Creasman & Tuttle LLP

(57) ABSTRACT

A developing roller includes a base portion, an elastic layer disposed on the outer circumference of the base portion, and a coating disposed on the outer peripheral surface of the elastic layer. The ten-point mean roughness of the coating according to JIS B 0601:1994 is from 2 to 4 micrometers. Furthermore, the mean spacing of profile irregularities of the coating according to JIS B 0601:1994 is from 120 to 290 micrometers. Furthermore, the surface free energy of the coating according to the Owens-Wendt-Rabel-Kaelble method is from 5 to 25 millinewtons per meter.

5 Claims, 3 Drawing Sheets

FIG. 4

| | Rz (μm) | Sm (μm) | γ (mN/m) | DEVELOPING PERFORMANCE | | FOG | | FIXING OFFSET |
|---|---|---|---|---|---|---|---|---|
| | | | | INITIAL | 1,500TH SHEET | INITIAL | 1,500TH SHEET | |
| EX1 | 2.97 | 137.27 | 11.98 | ○ | ○ | ○ | ○ | ○ |
| EX2 | 2.05 | 288.50 | 11.70 | ○ | ○ | ○ | ○ | ○ |
| EX3 | 3.89 | 123.09 | 12.09 | ○ | ○ | ○ | ○ | ○ |
| EX4 | 2.92 | 140.55 | 5.39 | ○ | ○ | ○ | ○ | ○ |
| EX5 | 3.15 | 125.46 | 24.18 | ○ | ○ | ○ | ○ | ○ |
| EX6 | 2.23 | 248.57 | 18.45 | ○ | ○ | ○ | ○ | ○ |
| EX7 | 3.81 | 154.23 | 19.09 | ○ | ○ | ○ | ○ | ○ |
| EX8 | 3.51 | 125.61 | 17.24 | ○ | ○ | ○ | ○ | ○ |
| COM1 | 4.30 | 150.33 | 12.15 | ○ | × | ○ | × | ○ |
| COM2 | 3.12 | 115.25 | 11.55 | ○ | ○ | ○ | ○ | × |
| COM3 | 2.88 | 302.70 | 13.15 | × | × | × | × | ○ |
| COM4 | 3.05 | 125.15 | 26.51 | × | × | × | × | ○ |
| COM5 | 4.85 | 130.31 | 13.55 | ○ | × | ○ | × | ○ |
| COM6 | 5.38 | 110.82 | 8.23 | ○ | × | ○ | × | ○ |
| COM7 | 4.31 | 210.11 | 11.31 | ○ | × | ○ | × | ○ |
| COM8 | 3.19 | 121.73 | 29.81 | ○ | × | ○ | × | ○ |
| COM9 | 2.93 | 147.76 | 28.41 | ○ | × | ○ | × | ○ |

DEVELOPING ROLLER, DEVELOPING DEVICE, IMAGE FORMING APPARATUS

INCORPORATION BY REFERENCE

This application is based upon and claims the benefit of priority from the corresponding Japanese Patent Application No. 2020-168984 filed on Oct. 6, 2020, the entire contents of which are incorporated herein by reference.

The present disclosure relates to a developing roller, a developing device, and an image forming apparatus that perform development by an electrophotographic method.

BACKGROUND

A developing device that performs development by an electrophotographic method includes a developing roller that supplies developer to an image-carrying member. The state of a coating serving as the outer peripheral surface of the developing roller greatly affects the developing performance. For example, the development density tends to be insufficient when the surface roughness of the developing roller is too low, whereas images tend to be rough when the surface roughness is too high.

For example, to prevent fogging in hot and humid conditions, it is known that the developing roller has a surface with the ten-point mean roughness (Rz) between 3 and 12 micrometers (both inclusive) and the mean spacing of profile irregularities (Sm) between 30 and 150 micrometers (both inclusive).

SUMMARY

A developing roller according to an aspect of the present disclosure is driven to rotate while facing an image-carrying member, the image-carrying member having a surface on which an electrostatic latent image is formed, and supplies particulate developer to the image-carrying member to develop the electrostatic latent image. The developing roller includes a base portion, an elastic layer disposed on the outer circumference of the base portion, and a coating disposed on the outer peripheral surface of the elastic layer. The ten-point mean roughness (Rz) of the coating according to JIS B 0601:1994 is from 2 to 4 micrometers. Furthermore, the mean spacing of profile irregularities (Sm) of the coating according to JIS B 0601:1994 is from 120 to 290 micrometers. Furthermore, the surface free energy (γ) of the coating according to the Owens-Wendt-Rabel-Kaelble method is from 5 to 25 millinewtons per meter.

A developing device according to another aspect of the present disclosure includes developer in a particulate form, a developer tank storing the developer, and the developing roller supplying the developer in the developer tank to an image-carrying member. An image forming apparatus according to yet another aspect of the present disclosure includes an image-carrying member that has a surface on which an electrostatic latent image is formed and the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 4 shows test results of performance evaluation of the developing device.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

A developing device 5 according to the embodiment performs development by an electrophotographic method. The developing device 5 constitutes an image forming apparatus 10. The image forming apparatus 10 performs a print process to form images on sheets.

Figure 1:
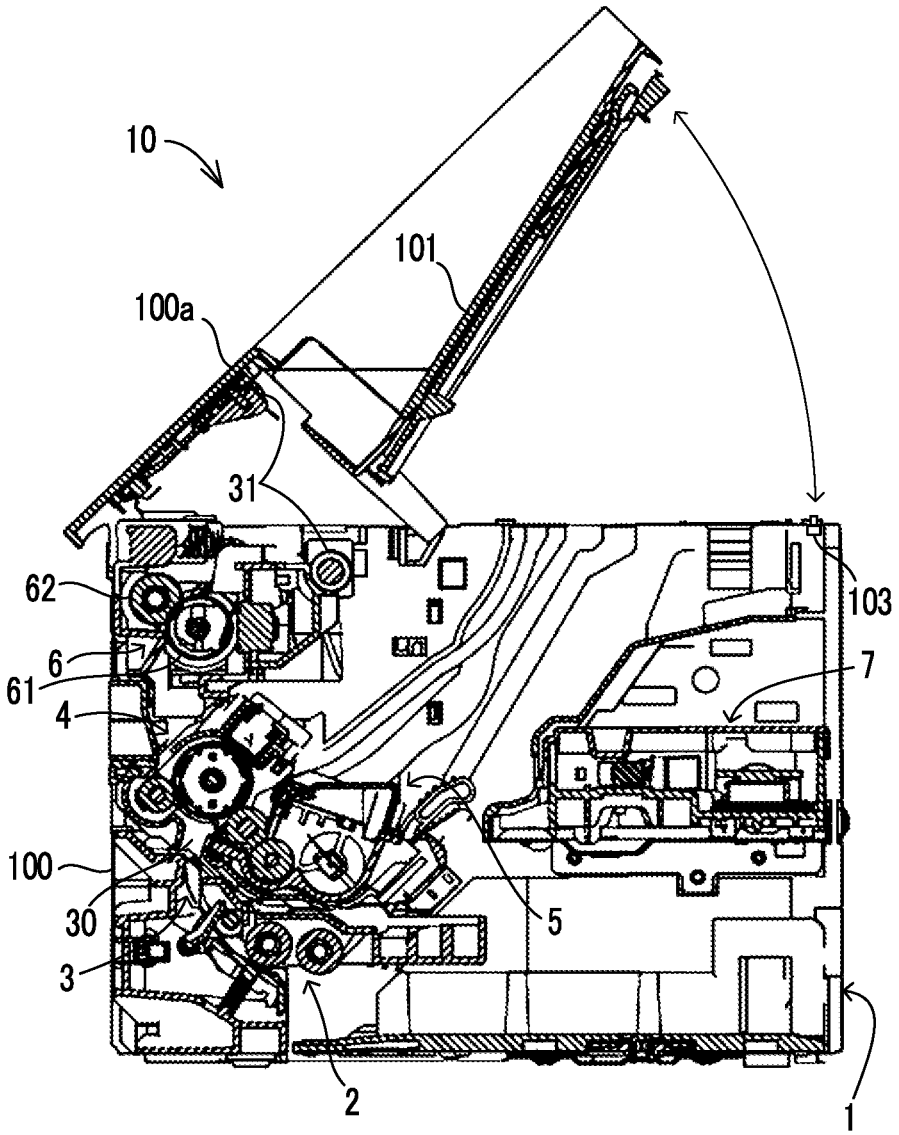
FIG. 1 is a configuration diagram of an image forming apparatus including a developing device according to an embodiment.

As shown in FIG. 1, the image forming apparatus 10 includes internal devices such as a sheet cassette 1, a sheet feed mechanism 2, a sheet conveying mechanism 3, a drum unit 4, the developing device 5, a fixing device 6, and an exposure device 7. The image forming apparatus 10 further includes a body portion 100 serving as a housing that stores the internal devices.

It is noted that FIG. 1 shows the body portion 100 with a cover portion 100*a* , constituting the top surface thereof, open.

The sheet feed mechanism 2 feeds sheets stored in the sheet cassette 1 one at a time to a conveyance path 30 inside the body portion 100. The sheet conveying mechanism 3 includes at least one pair of conveying rollers 31 that convey the sheet along the conveyance path 30.

The sheet conveying mechanism 3 discharges the sheet on which an image has been formed from the conveyance path 30 to an output tray 101. The output tray 101 is formed in the cover portion 100*a* (see FIG. 1).

Figure 2:
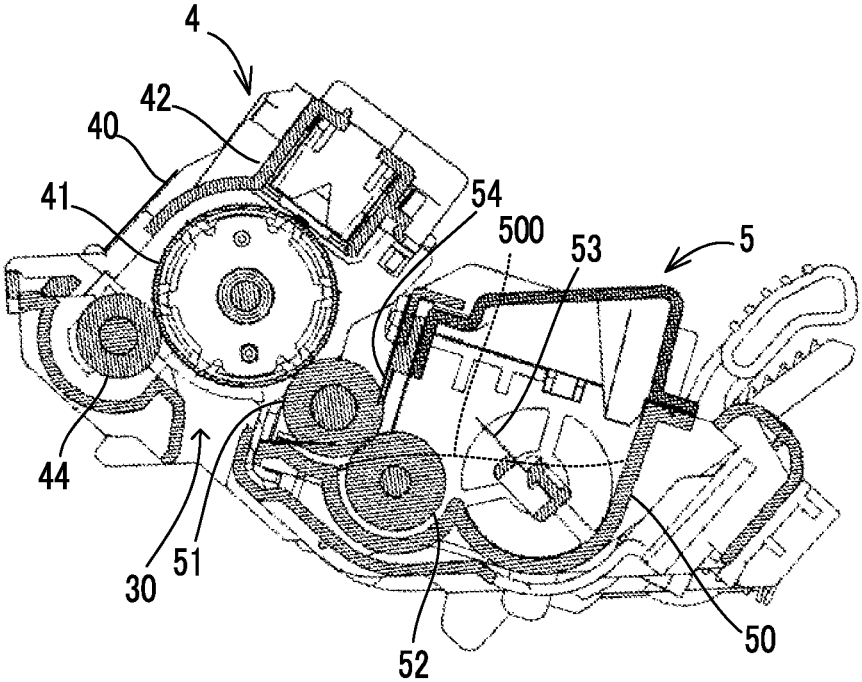
FIG. 2 is a cross-sectional view of the developing device according to the embodiment and a drum unit.

As shown in FIG. 2, the drum unit 4 includes a unit housing 40, a drum-like photoconductor 41, a charger 42, and a transfer roller 44. The unit housing 40 supports the photoconductor 41, the charger 42, and the transfer roller 44.

The charger 42 charges the surface of the photoconductor 41. In the present embodiment, the photoconductor 41 is a single-layer organic photoconductor. The charger 42 is a scorotron charger that includes a grid electrode to which voltage is applied to charge the photoconductor 41 by guiding ions produced by corona discharge to the photoconductor 41

The exposure device 7 exposes the surface of the photoconductor 41 to a laser beam to form an electrostatic latent image on the surface of the photoconductor 41. The electrostatic latent image is developed as a toner image by the developing device 5. The photoconductor 41 is an example of an image-carrying member that has a surface on which the electrostatic latent image is formed and that rotates while carrying the toner image.

The transfer roller 44 transfers the toner image from the photoconductor 41 to the sheet. The image forming apparatus 10 does not include a cleaning mechanism for scraping off toner 500 remaining on the surface of the photoconductor 41 after the toner image is transferred. That is, the surface of the photoconductor 41 does not come into contact with any other members in an area (non-contact area) between a part facing the transfer roller 44 and a part facing the charger 42.

The fixing device 6 includes a fixing roller 61 heated by a heater and a pressure roller 62 that presses the sheet against the fixing roller 61. The fixing device 6 fixes the toner image transferred to the sheet onto the sheet by heating and pressurizing the toner image.

As shown in FIG. 2, the developing device 5 includes the toner 500, a developer tank 50, a developing roller 51, a supply roller 52, a stirring paddle 53, and a regulating blade 54. The toner 500 is an example of developer in a particulate form. The developer tank 50 is a container that stores the toner 500.

The photoconductor 41, the developing roller 51, the supply roller 52, the stirring paddle 53, and the transfer roller 44 are driven to rotate by a motor (not shown).

The developing roller 51 is rotatably supported to face the photoconductor 41. The developing roller 51 rotates while carrying the toner 500 on the outer peripheral surface thereof. The developing roller 51 supplies the toner 500 in the developer tank 50 to the surface of the photoconductor 41 to develop the electrostatic latent image on the surface of the photoconductor 41.

The supply roller 52 supplies the toner 500 in the developer tank 50 to the outer peripheral surface of the developing roller 51. That is, the developing roller 51 supplies the toner 500 in the developer tank 50 to the surface of the photoconductor 41 via the supply roller 52.

The stirring paddle 53 stirs the toner 500 in the developer tank 50. The regulating blade 54 comes into contact with the toner 500 on the outer peripheral surface of the developing roller 51 to limit the thickness of the toner 500 carried by the developing roller 51 to a predetermined level.

Figure 3:
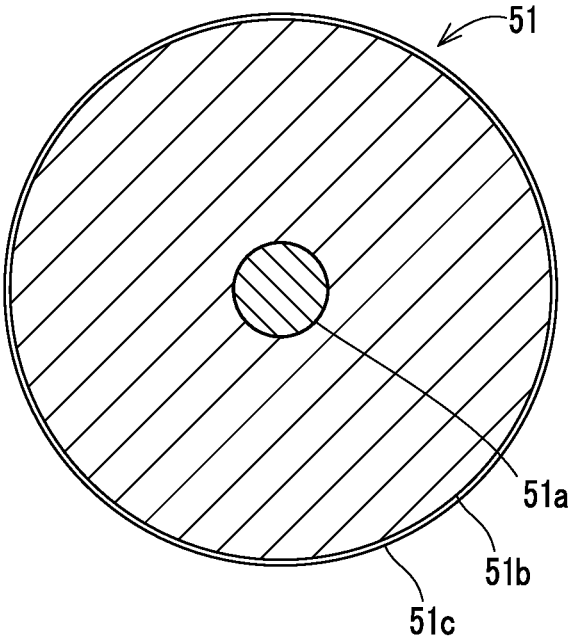
FIG. 3 is cross-sectional view of a developing roller in the developing device according to the embodiment.

As shown in FIG. 3, the developing roller 51 includes a base portion 51*a* , an elastic layer 51*b* disposed on the outer circumference of the base portion 51*a* , and a coating 51*c* disposed on the outer peripheral surface of the elastic layer 51*b* . The coating 51*c* serves as an outermost layer of the developing roller 51.

The base portion 51*a* is a metal core member. The elastic layer 51*b* is a synthetic rubber member. The state of the coating 51*c* serving as the outer peripheral surface of the developing roller 51 greatly affects the developing performance. For example, the development density tends to be insufficient when the surface roughness of the developing roller 51 is too low, whereas images tend to be rough when the surface roughness is too high.

When the coating 51*c* has a higher surface roughness within a range that causes no roughness in images, the developing roller 51 can carry the toner 500 to the photoconductor 41 more efficiently. On the other hand, the coating 51*c* with a high surface roughness wears easily and can maintain sufficient development density only for a short period of time.

A reduction in the development density is prevented by a correction that increases developing bias output to the developing roller 51 and that subsequently reduces the difference between the developing bias and the light-part potential on the photoconductor 41; however, reducing the difference between the developing bias and the light-part potential on the photoconductor 41 causes so-called development fog.

The following describes the configuration of the developing device 5 capable of maintaining a sufficient development density for the long term and, furthermore, preventing the development fog.

FIG. 4 is a table showing test results of developing performance evaluation in eight Examples EX1 to EX8 and nine Comparative Examples COM1 to COM9 of the developing device 5. In the examples, conditions of the coating 51*c* of the developing roller 51 varied from each other.

In Examples EX1 to EX8 and Comparative Examples COM1 to COM9, the conditions of the coating 51*c* mainly affecting the developing performance were ten-point mean roughness (Rz) according to JIS B 0601:1994 defined in Japanese Industrial Standards (JIS), mean spacing of profile irregularities (Sm) according to the same standard, and surface free energy (γ) according to OWRK (Owens-Wendt-Rabel-Kaelble) method.

The surface free energy (γ) according to the OWRK method was calculated by measuring contact angles between the coating 51*c* and three kinds of liquid (herein water, polyethylene glycol 2000, and tricresyl phosphate) using the sessile drop method and then applying the measured contact angles to the known OWRK equation for the surface free energy (γ). In the test results shown in FIG. 4, the unit of the ten-point mean roughness (Rz) and the mean spacing of profile irregularities (Sm) was the micrometer, whereas the unit of the surface free energy (γ) was the millinewton per meter.

In Examples EX1 to EX8 and Comparative Examples COM1 to COM9, the coating 51*c* was formed from urethane, and the hardness of the coating 51*c* measured using a micro durometer MD-1 was 50.

In addition, in Examples EX1 to EX8 and Comparative Examples COM1 to COM9, the developing device 5 performed non-magnetic single-component contact development. More specifically, the developing device 5 performed development by bringing the toner 500, which was a non-magnetic single-component developer, into contact with the surface of the photoconductor 41. The polarity of the charged toner 500 was positive. For example, the toner 500 was black toner mainly formed from polyester resin.

In addition, in Examples EX1 to EX8 and Comparative Examples COM1 to COM9, the mean volume diameter of the toner 500 determined by particle-size measurement using a Coulter Counter® was within a range of 6 to 10 micrometers.

In addition, five items evaluated in Examples EX1 to EX8 and Comparative Examples COM1 to COM9 were initial developing performance, developing performance when the print process was performed on the 1,500th sheet, initial development fog, development fog when the print process was performed on the 1,500th sheet, and fixing offset.

It is noted that the image forming apparatus 10 of an entry model was required to have no failure until the print process was performed on the 1,500 sheets for quality assurance.

In Examples EX1 to EX8 and Comparative Examples COM1 to COM9, a predetermined test image was formed on a white sheet in the print process, and the state of the test image was evaluated for the five evaluation items. The test image was a predetermined, uniformly solid image with a maximum density. In the description below, the sheet on which the test image was formed is referred to as "test sheet".

Under conditions where the developing bias applied to the developing roller 51 was set in a range of more than or equal to 150 volts to less than 250 volts, the developing performance was evaluated as good when the density of the test image was more than or equal to a reference density; otherwise the developing performance was evaluated as poor.

It is noted that, in Examples EX1 to EX8 and Comparative Examples COM1 to COM9, the potential of the unexposed part on the charged surface of the photoconductor 41 was 680 volts, and the potential of the exposed part was 115 olts.

The density of the test image was measured using a predetermined densitometer. The reference density was an image density of 1.3 measured using the densitometer. The densitometer used for the measurement was TC-6DS manufactured by Tokyo Denshoku Co., Ltd.

In the section of developing performance in FIG. 4, circles indicate that the developing performance was evaluated as good, whereas crosses indicate that the developing performance was evaluated as poor.

The development fog was evaluated as not formed when the density on the test sheet in an area adjacent to an original area of the test image measured using the densitometer was less than a predetermined upper-limit density, otherwise the development fog was evaluated as formed.

The upper-limit density was an image density of 0.01 measured using the densitometer.

In the section of development fog in FIG. 4, circles indicate that the development fog was evaluated as not formed, whereas crosses indicate that the development fog was evaluated as formed.

In addition, the fixing offset was evaluated by visually checking whether periodic density unevenness corresponding to the perimeter of the fixing roller 61 occurred in the test image. In the section of fixing offset in FIG. 4, circles indicate that the fixing offset was evaluated as absent, whereas crosses indicate that the fixing offset was evaluated as present.

As shown in FIG. 4, the ten-point mean roughness (Rz) above 4 micrometers caused poor developing performance and formation of development fog in the test image on the 1,500th test sheet (see Comparative Examples COM1, COM5 to COM7).

Due to production limitations of the coating 51*c* , it is difficult to reduce the ten-point mean roughness (Rz) of the coating 51*c* to less than 2 micrometers.

In addition, the mean spacing of profile irregularities (Sm) of the coating 51*c* below 120 micrometers caused an occasional fixing offset (see Comparative Example COM2).

In contrast, the mean spacing of profile irregularities (Sm) of the coating 51*c* above 290 micrometers was likely to cause poor developing performance from an early stage (see Comparative Example COM3).

Similarly, the surface free energy (γ) of the coating 51*c* above 25 millinewtons per meter was likely to cause poor developing performance in the test image on at least the 1,500th test sheet (see Comparative Examples COM4, COM8, and COM9). Due to production limitations of the coating 51*c* , it is difficult to reduce the surface free energy (γ) of the coating 51*c* to less than 5 millinewtons per meter.

As described above, the test results shown in FIG. 4 indicate that the requirements of the coating 51*c* for maintaining sufficient development density for the long term and, furthermore, for preventing the development fog are as follows.

That is, the coating 51*c* is required to have a ten-point mean roughness (Rz) from 2 to 4 micrometers, a mean spacing of profile irregularities (Sm) from 120 to 290 micrometers, and a surface free energy (γ) from 5 to 25 millinewtons per meter (see Examples EX1 to EX8). In FIG. 4, items with data that does not meet the requirements are outlined in bold lines.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing roller driven to rotate while facing an image-carrying member, the image-carrying member having a surface on which an electrostatic latent image is formed, and supplying particulate developer to the image-carrying member to develop the electrostatic latent image, the developing roller comprising:

a base portion;

an elastic layer disposed on an outer circumference of the base portion; and a coating disposed on an outer peripheral surface of the elastic layer, wherein a ten-point mean roughness (Rz) of the coating according to JIS B 0601:1994 is from 2 to 4 micrometers, a mean spacing of profile irregularities (Sm) of the coating according to JIS B 0601:1994 is from 120 to 290 micrometers, and a surface free energy (γ) of the coating according to the Owens-Wendt-Rabel-Kaelble method is from 5 to 25 millinewtons per meter.

2. A developing device comprising:

developer in a particulate form;

a developer tank storing the developer; and the developing roller according to claim 1 supplying the developer in the developer tank to an image-carrying member.

3. The developing device according to claim 2, wherein the developing device performs non-magnetic single-component contact development.

4. The developing device according to claim 3, wherein the developer is a non-magnetic single-component developer having a mean volume diameter of 6 to 10 micrometers, the mean volume diameter being determined by particle-size measurement using a Coulter Counter®.

5. An image forming apparatus comprising:

an image-carrying member having a surface on which an electrostatic latent image is formed; and the developing device according to claim 2.

* * * * *